US008222568B2

(12) United States Patent
Hsu

(10) Patent No.: US 8,222,568 B2
(45) Date of Patent: Jul. 17, 2012

(54) ELECTRONICALLY HEATED TOOL FOR USE IN INSTALLATION OF ANCHORING DEVICES EMPLOYING HOT MELT ADHESIVES

(76) Inventor: Chia-Wen Hsu, Taichung Hsien (TW)

( * ) Notice: Subject to any disclaimer, the term of this patent is extended or adjusted under 35 U.S.C. 154(b) by 295 days.

(21) Appl. No.: 12/785,073

(22) Filed: May 21, 2010

(65) Prior Publication Data

US 2011/0284517 A1 Nov. 24, 2011

(51) Int. Cl.
*B25B 31/00* (2006.01)

(52) U.S. Cl. ..... 219/229; 219/230; 219/521

(58) Field of Classification Search ..... 219/230, 219/229, 521
See application file for complete search history.

(56) References Cited

U.S. PATENT DOCUMENTS

| | | | | | |
|---|---|---|---|---|---|
| 2,058,634 | A | * | 10/1936 | Rusk | 226/128 |
| 2,094,795 | A | * | 10/1937 | Johnson | 228/53 |
| 2,228,291 | A | * | 1/1941 | Weston | 219/230 |
| 2,251,557 | A | * | 8/1941 | Weston | 219/230 |
| 2,432,428 | A | * | 12/1947 | Lang | 228/52 |
| 2,748,245 | A | * | 5/1956 | Pearce et al. | 219/230 |
| 2,751,485 | A | * | 6/1956 | Sauer | 228/53 |
| 2,951,927 | A | * | 9/1960 | Weller | 219/241 |
| 3,096,554 | A | * | 7/1963 | Johnson | 188/67 |
| 3,539,766 | A | * | 11/1970 | Eder | 219/149 |
| 3,593,001 | A | * | 7/1971 | Simpson et al. | 219/243 |
| 3,632,973 | A | * | 1/1972 | O'Keefe | 219/230 |
| 3,637,129 | A | * | 1/1972 | Kaufman | 228/20.5 |
| 3,665,158 | A | * | 5/1972 | Froedge | 219/421 |
| 3,719,792 | A | * | 3/1973 | Cuccaro | 219/230 |
| 3,900,714 | A | * | 8/1975 | Beyer | 219/229 |
| 4,045,651 | A | * | 8/1977 | Koo | 219/227 |
| 4,093,491 | A | * | 6/1978 | Whelpton et al. | 156/66 |
| 4,176,778 | A | * | 12/1979 | Fortune | 228/57 |
| 4,206,864 | A | * | 6/1980 | Rauchwerger | 228/20.5 |
| 4,301,357 | A | * | 11/1981 | Huffman | 219/229 |
| 4,318,504 | A | * | 3/1982 | Rauchwerger | 228/20.5 |
| 4,620,889 | A | * | 11/1986 | Winter et al. | 156/166 |
| 4,690,724 | A | * | 9/1987 | Outlaw | 156/752 |
| 4,771,161 | A | * | 9/1988 | Levy et al. | 219/228 |
| 4,858,593 | A | * | 8/1989 | Hsu | 126/414 |
| 4,916,288 | A | * | 4/1990 | Redden | 219/228 |
| 5,895,593 | A | * | 4/1999 | Lima | 219/228 |
| 6,040,559 | A | * | 3/2000 | Chou | 219/229 |
| 6,455,813 | B1 | * | 9/2002 | Sakamoto et al. | 219/229 |
| 6,627,036 | B1 | * | 9/2003 | Suendermann | 156/322 |
| 2003/0015512 | A1 | * | 1/2003 | Sakamoto et al. | 219/229 |
| 2005/0247692 | A1 | * | 11/2005 | Axinte et al. | 219/240 |
| 2007/0187385 | A1 | * | 8/2007 | Axinte et al. | 219/229 |
| 2011/0284517 | A1 | * | 11/2011 | Hsu | 219/229 |

* cited by examiner

*Primary Examiner* — Laura Menz
(74) *Attorney, Agent, or Firm* — Steptoe & Johnson LLP

(57) ABSTRACT

An electrically heated tool adapted for an anchoring device includes a housing having an opening, a heating head extending forwardly out of the opening, and a movable member disposed movably on the heating head and extending forwardly out of the opening. The movable member has an engagement hole permitting extension of the heating head therethrough, a front annular surface, a loading portion disposed on the front annular surface, and a loading space defined between the loading portion and the front annular surface. The movable member is movable relative to the heating head between an extended position whereat a front pressing surface of the heating head is spaced apart from a forwardly protruding nose of the device, and a retracted position whereat the front pressing surface contacts the nose. A spring is disposed for biasing the movable member toward the extended position.

8 Claims, 8 Drawing Sheets

ELECTRONICALLY HEATED TOOL FOR USE IN INSTALLATION OF ANCHORING DEVICES EMPLOYING HOT MELT ADHESIVES

BACKGROUND OF THE INVENTION

1. Field of the Invention

This invention relates to an electrically heated tool, and more particularly to an electrically heated tool for use in installation of anchoring devices employing hot melt adhesive.

2. Description of the Related Art

As shown in FIGS. 1 and 2, a conventional electrically heated tool (as disclosed in the U.S. Pat. No. 4,771,161) includes a housing 1 and a heating head 2. The housing 1 has a planar front wall 101 provided with a front recess 102 dimensioned to receive an anchoring device 3. The heating head 2 extends forwardly into the front recess 102. The anchoring device 3 has a forwardly protruding nose 301 carrying a hot melt adhesive 304, and a rear recess 302 surrounded by a circular rim 303. When a user intends to adhere the anchoring device 3 to a support surface 4, the anchoring device 3 has to be first placed into the front recess 102 so as to sleeve the forwardly protruding nose 301 on the heating head 2. Next, the electrically heated tool is operated to press the anchoring device 3 against the support surface 4 for heating the hot melt adhesive 304 for a predetermined time period so that the anchoring device 3 is adhered to the support surface 4.

However, in practice, the electrically heated tool has the following disadvantages:

1) When the user manipulates to sleeve the anchoring device 3 on the heating head 2, his or her fingers have to be relatively close to the heating head 2, which is prone to cause a burning accident.

2) Since the anchoring device 3 is engaged to the heating head 2 by only sleeving the protruding forwardly protruding nose 301 on the same, it is prone to drop off before it is pressed against the support surface 4.

3) The electrically heated tool does not provide functionality for notifying the user that the hot melt adhesive 304 has been heated for a sufficient time period. As a result, the hot melt adhesive 304 may be overheated, thereby affecting adversely adhesion of the anchoring device 3 onto the support surface 4.

4) When the user employs the electrically heated tool to reheat the hot melt adhesive 304 for removing the anchoring device 3, another tool (not shown) has to be incorporated in use to enable removal of the anchoring device 3 from the support surface 4. It is inconvenient for use in this viewpoint.

SUMMARY OF THE INVENTION

The object of this invention is to provide an electrically heated tool designed for easy installation and removal of an anchoring device employing hot melt adhesive.

Accordingly, an electrically heated tool according to this invention is adapted for applying an anchoring device to a support surface. The anchoring device has a forwardly protruding nose for carrying hot melt adhesive, a rear recess, and a rim surrounding the rear recess. The electrically heated tool comprises: a housing, a heating unit and a movable unit. The housing has an opening. The heating unit is disposed in the housing, and has a heating head that extends forwardly out of the housing through the opening and that has a front pressing surface. The movable unit includes a movable member disposed movably on the heating head and extending forwardly out of housing through the opening, and a spring disposed between and abutting against the movable member and an assembly of the housing and the heating head. The movable member has an engagement hole permitting extension of the heating head therethrough, a front annular surface surrounding the engagement hole, a loading portion disposed on the front annular surface, and at least one loading space is defined between the loading portion and the front annular surface. The movable member is movable relative to the heating head between an extended position and a retracted position such that, when the movable member is at the extended position, the front pressing surface of the heating head is spaced apart from the forwardly protruding nose of the anchoring device, and when the movable member is at the retracted position, the front pressing surface is in thermal contact with the forwardly protruding nose. The spring biases the movable member toward the extended position.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 3:
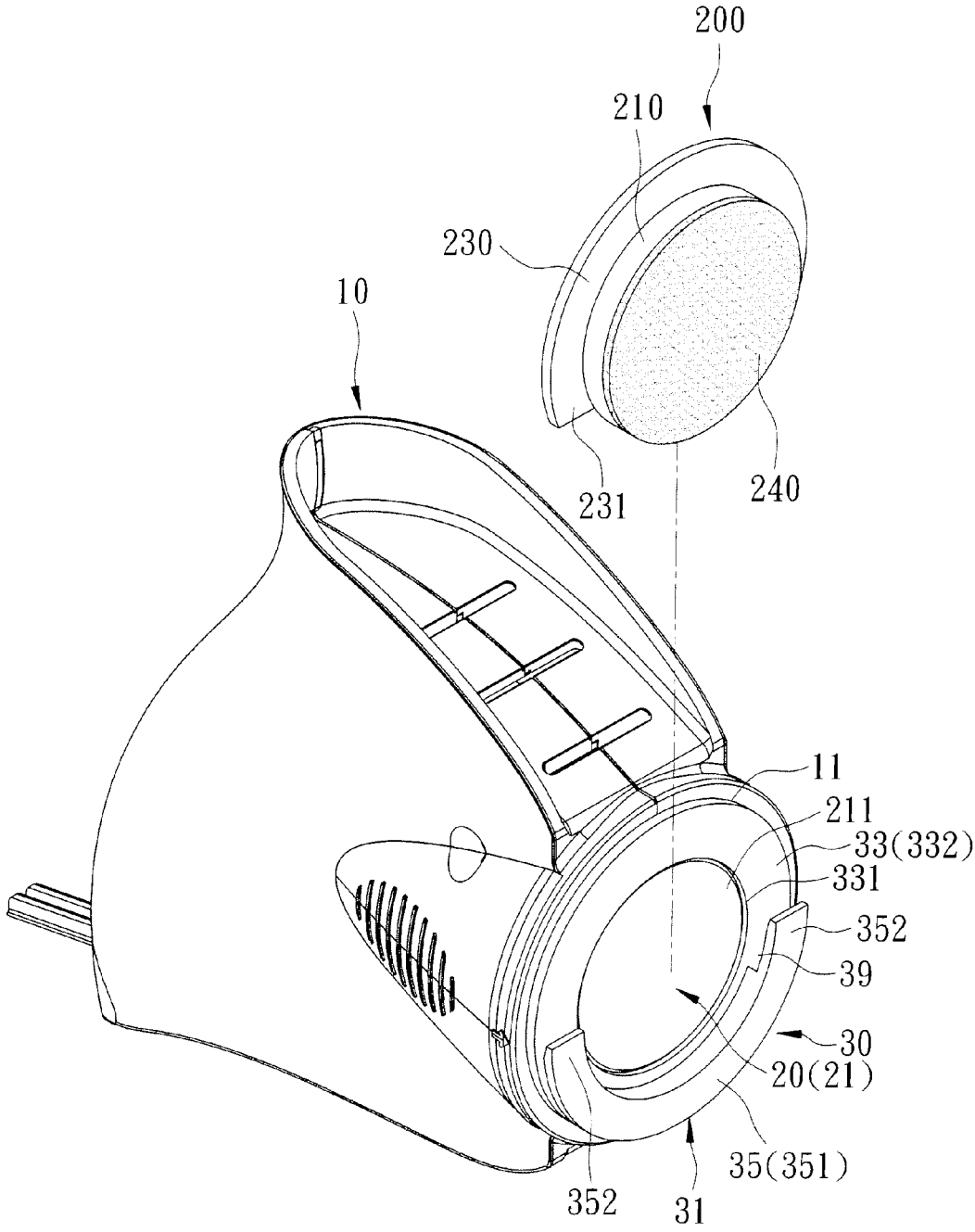
FIG. 3 is a perspective view of the preferred embodiment of an electrically heated tool for use in installation of anchoring devices employing hot melt adhesive according to the present invention.
Figure 4:
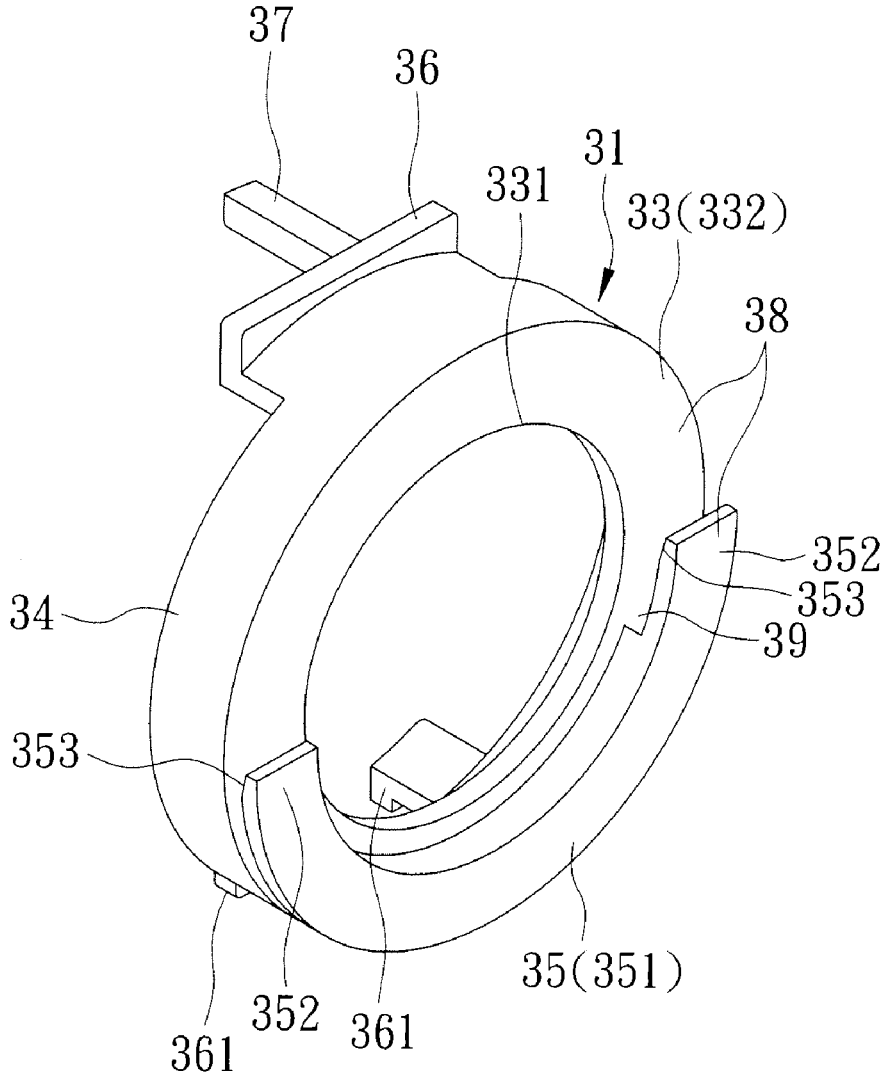
FIG. 4 is a perspective view of a movable member of a movable unit of the preferred embodiment.
Figure 5:
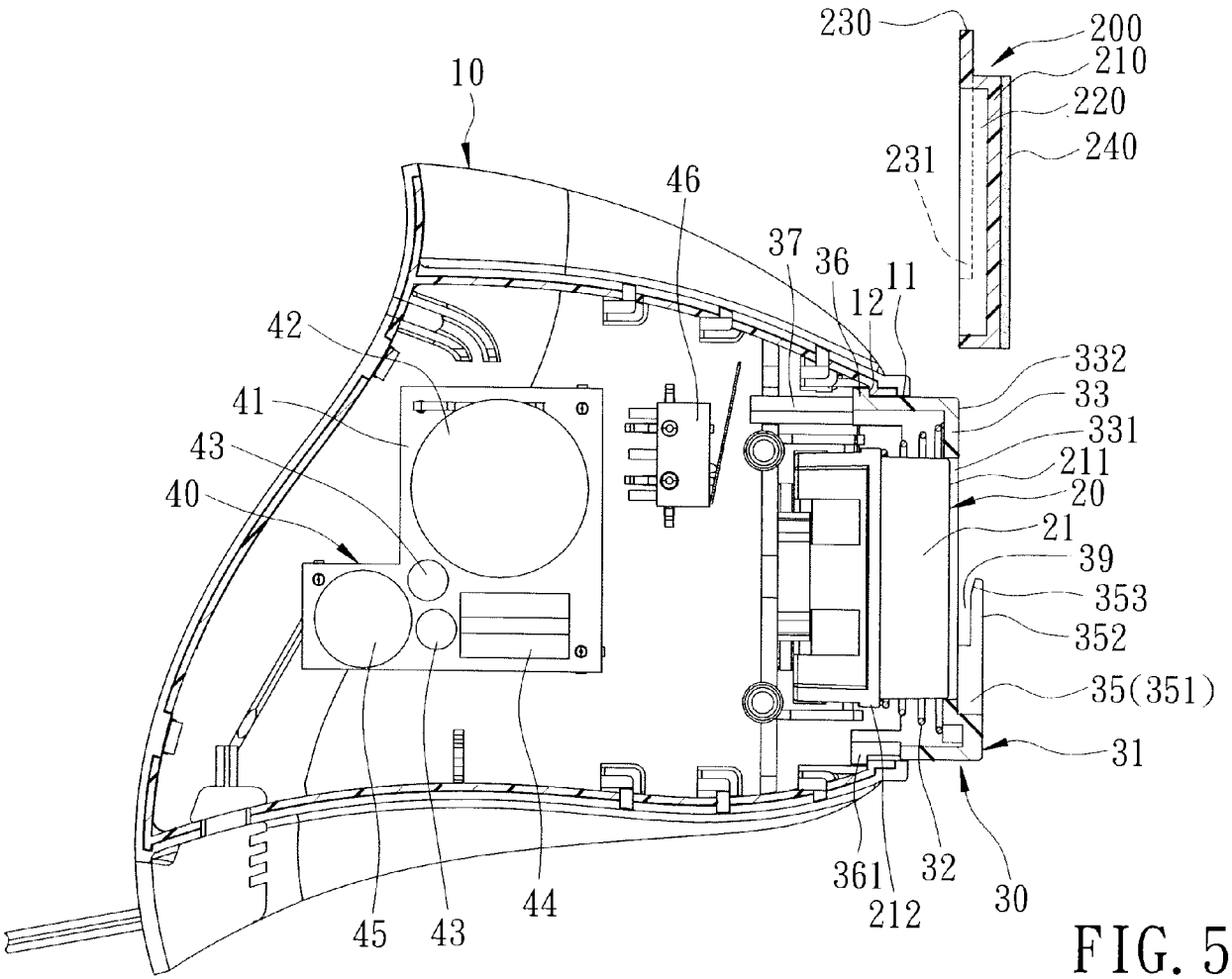
FIG. 5 is a schematic sectional view of the preferred embodiment, illustrating how the preferred embodiment is incorporated with an anchoring device employing hot melt adhesive and how the movable member is disposed at an extended position.

Referring to FIGS. 3, 4 and 5, the preferred embodiment of an electrically heated tool according to the present invention is adapted for use in installation of an anchoring device 200. The anchoring device 200 has a forwardly protruding nose 210 for carrying hot melt adhesive 240, a rear recess 220, and a rim 230 surrounding the rear recess 220. The rim 230 has a pair of bottom end portions 231. The electrically heated tool comprises: a housing 10, a heating unit 20, a movable unit 30 and an alarming unit 40.

The housing 10 has an opening 11 and a position-limiting shoulder 12 surrounding the opening 11.

The heating unit 20 is disposed in the housing 10, and has a heating head 21 that extends forwardly out of the housing 10 through the opening 11, and that has a front pressing surface 211, and an annular shoulder 212 disposed behind the front pressing surface 211.

The movable unit 30 includes a movable member 31 disposed movably on the heating head 21 and extending forwardly out of housing 10 through the opening 11, and a spring 32 disposed between and abutting against the movable member 31 and an assembly of the housing 10 and the heating head 21.

The movable member 31 has: a front end wall 33 that is formed with an engagement hole 331 permitting extension of the heating head 21 therethrough, and a front annular surface (i.e., front end surface) 332 surrounding the engagement hole 331; a surrounding wall 34 extending rearwardly from a periphery of the front end wall 33; a loading portion 35 disposed on the front annular surface 332; a first position-limiting hook 36 extending rearwardly from the surrounding wall 34; a plurality of second position-limiting hooks 361 extending rearwardly from the surrounding wall 34; a push rod 37 extending rearwardly from the first position-limiting hook 36 into the housing 10; and a color-variable temperature-sensing layer 38.

Figure 1:
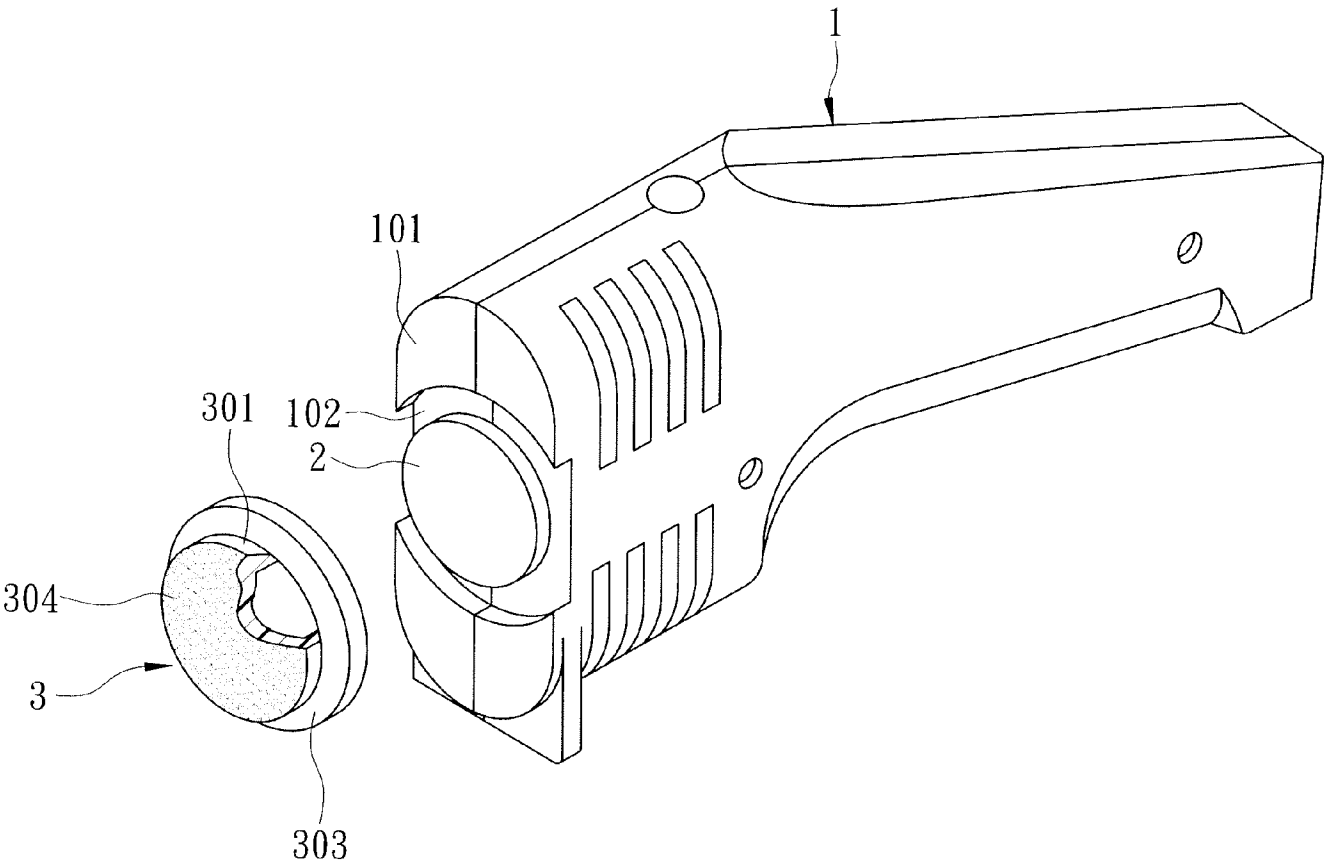
FIG. 1 PRIOR ART
FIG. 1 is a perspective view of a conventional electrically heated tool to be incorporated with an anchoring device employing hot melt adhesive.
Figure 2:
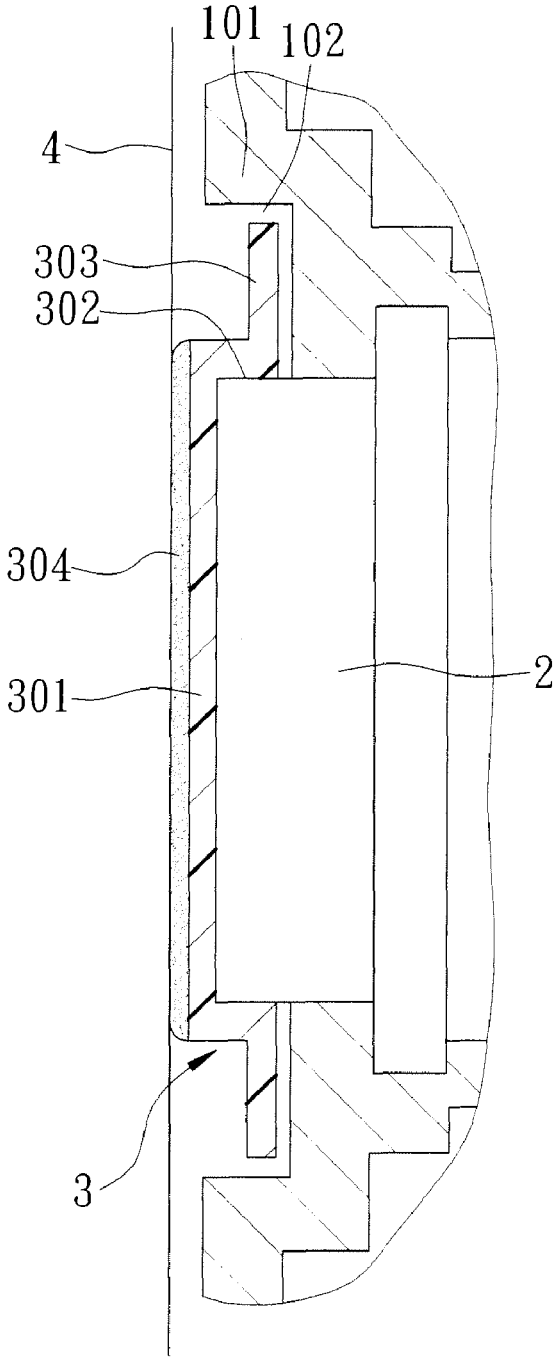
FIG. 2 PRIOR ART
FIG. 2 is a fragmentary sectional view of the conventional electrically heated tool, illustrating how the conventional electrically heated tool is used to adhere the anchoring device to a support surface.

The loading portion 35 is semi-ring shaped, and has a middle portion 351 connected to the front annular surface 332, and two hook sections 352 extending respectively upwardly from two opposite ends of a front portion of the middle portion 351. Each of the hook sections 352 has a rear side surface facing toward the front annular surface 332. Each of the rear side surfaces has an inclined guiding surface portion 353 at an upper end thereof. In this embodiment, each of the hook sections 352 cooperates with the front annular surface 332 to define a loading space 39 for receiving the corresponding bottom end portion 231 of the rim 230 of the anchoring device 200. It should be noted that, when the radial width of the middle portion 351 is shortened, this invention is capable of use with the anchoring device 3 (see FIG. 1) employed in the above-mentioned prior art.

The color-variable temperature-sensing layer 38 is disposed at the front annular surface 332 and the loading portion 35, and is variable in color as a result of a change in the temperature of the heating head 21.

The spring 32 is biased between the annular shoulder 212 of the heating head 21 and an inner side (i.e., rear side) of the front end wall 33 of the movable member 31.

Figure 6:
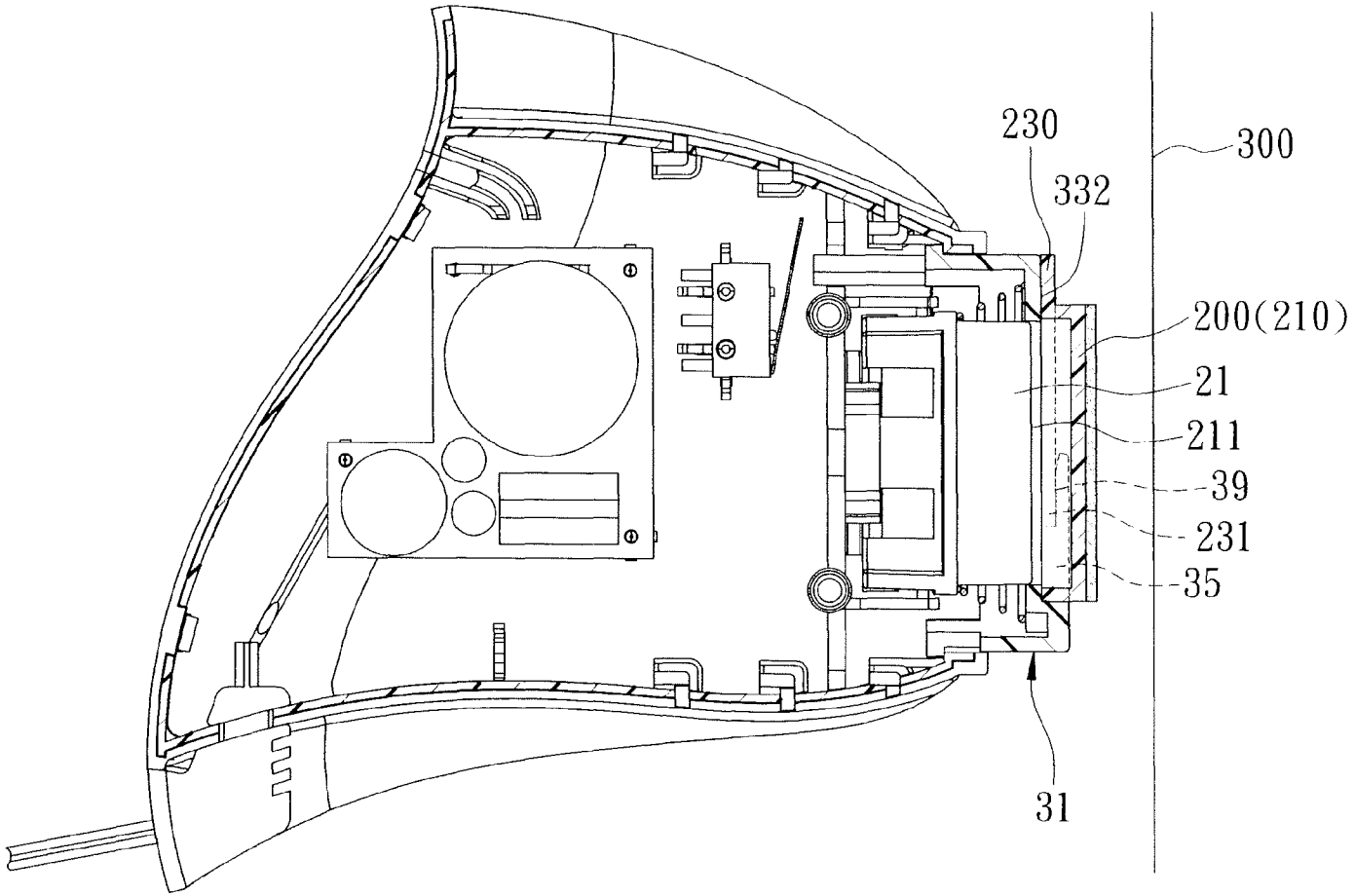
FIG. 6 is a view similar to FIG. 5 but illustrating how the anchoring device is positioned on the movable member.
Figure 7:
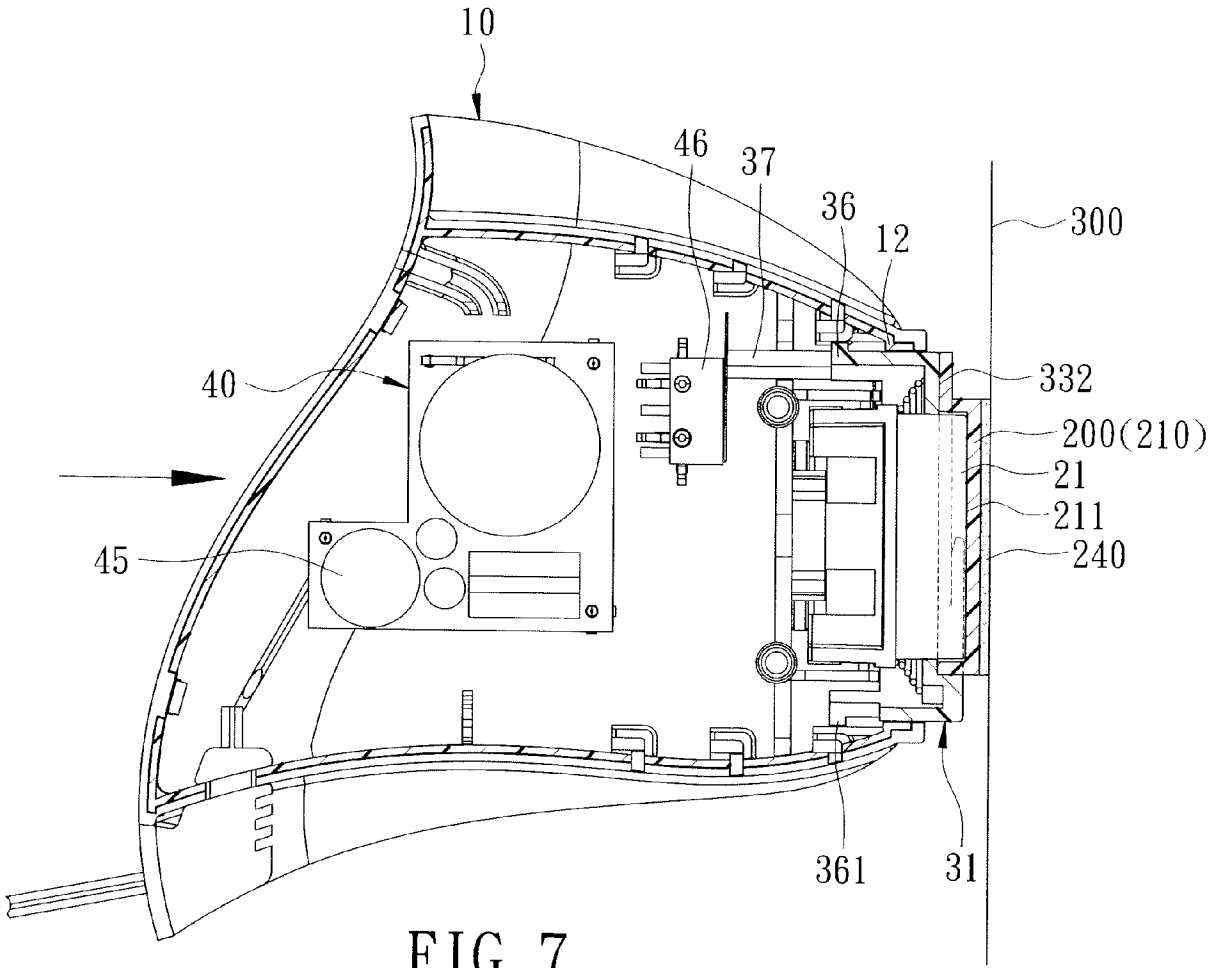
FIG. 7 is a view similar to FIG. 6 but illustrating how the preferred embodiment is used to adhere the anchoring device to a support surface and how the movable member is disposed at a retracted position.

The movable member 31 is operable to move together with the anchoring device 200 relative to the heating head 21 between an extended position (shown in FIGS. 5 and 6) and a retracted position (shown in FIG. 7). The spring biases the movable member 31 toward the extended position.

The alarming unit 40 is disposed in the housing 10, and includes a circuit board 41, a battery 42 mounted on the circuit board 41, a plurality of resistors 43 mounted on the circuit board 41, a capacitor 44 mounted on the circuit board 41, an alarm indicator 45 mounted on the circuit board 41, and a start switch 46 mounted in the housing 10 and connected electrically to the alarm indicator 45 through the resistors 43 and the capacitor 46. In this embodiment, the alarm indicator 45 is a buzzer. However, it should be noted that, in practice, the alarm indicator 45 may as well be a vibrator or any other component such as LED, etc., which can generate an alarming signal for the user.

As such, as shown in FIG. 5, when the movable member 31 is at the extended position, the spring 32 biases the position-limiting hooks 36, 361 to abut against the position-limiting shoulder 12 of the housing 10. In this position, the front pressing surface 211 of the heating head 21 is spaced apart from the forwardly protruding nose 210 of the anchoring device 200, and the push rod 73 is spaced apart from the start switch 46. When the user intends to use this invention to adhere the anchoring device 200 to a support surface 300, the anchoring device 200 is first moved to a position shown in FIG. 5 whereat the bottom end portions 231 of the rim 230 of the anchoring device 200 are disposed respectively and directly above and adjacent to the loading spaces 39 in the movable member 31. Next, the anchoring device 200 is released to drop so as to allow for engagement between the bottom end portions 231 of the rim 230 and the loading spaces 39. At this moment, the movable member 31 is still disposed at the extended position. That is, the front pressing surface 211 of the heating head 21 is spaced apart from the forwardly protruding nose 210 of the anchoring device 200.

As shown in FIG. 7, when the user operates the electrically heated tool to press the anchoring device 200 against the support surface 300, the anchoring device 200 pushes and moves the movable member 31 rearwardly relative to the heating head 21 to the retracted position. When the movable member 31 is at the retracted position, the front pressing surface 211 is disposed in front of the front annular surface 332 of the movable member 31, and is in thermal contact with the forwardly protruding nose 210 of the anchoring device 200, and the first and second position-limiting hooks 36, 361 of the movable member 31 are removed from the position-limiting shoulder 12 of the housing 10. The push rod 37 comes into contact with and activates the start switch 46 when the movable member 31 is moved to the retracted position. In response to activation of the start switch 46, the heating head 21 is operated to heat the hot melt adhesive 240 on the anchoring device 200 so that the anchoring device 200 is adhered to the support surface 300 by the hot melt adhesive 240. After a predetermined time period of heating the hot melt adhesive 240, the alarm indicator 45 is controlled to generate an alarming signal to notify the user that the predetermined heating time period has expired. Hence, through operation of the alarming unit 40, the user can remove the anchoring device 200 timely.

Figure 8:
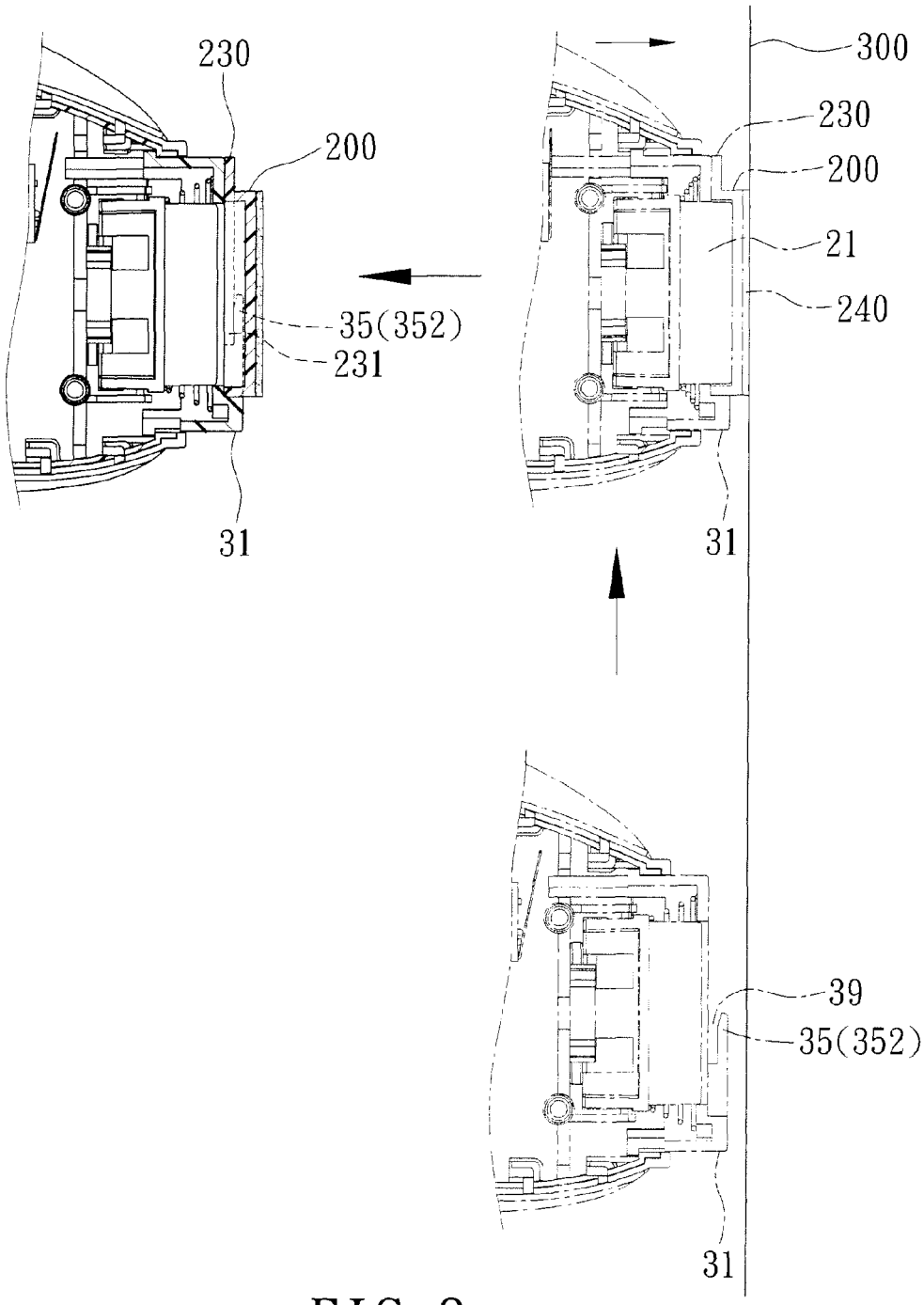
FIG. 8 is a view similar to FIG. 7 but illustrating how the preferred embodiment is operated to remove the anchoring device from the support surface.

As shown in FIG. 8, when it is desired to employ the electrically heated tool to reheat the anchoring device 200 for removal of the anchoring device 200, the movable member 31 is moved to a position under the anchoring device 200 and then moved upwardly along the support surface 300 to engage the bottom end portions 231 of the rim 230 with the loading spaces 39. Subsequently, the electrically heated tool is pressed against the anchoring device 200 such that the hot melt adhesive 240 is heated and softened by the heating head 21, thereby allowing the anchoring device 200 to be pulled to separate from the support surface 300 by the hook sections 352 of the loading portion 35 of the movable member 31.

From the foregoing, the advantages of this invention are summarized as follows:

1) When the bottom end portions 231 of the rim 230 of the anchoring device 200 are moved into the loading spaces 39, respectively, the user's fingers are protected by the movable member 31 from contact with the heating head 21. As a consequence, the burning accident prone to take place during use of the above-mentioned prior art is prevented.

2) When the bottom end portions 231 of the rim 230 of the anchoring device 200 are moved into the loading spaces 39, the hook sections 352 of the loading portion 35 of the movable member 31 engage respectively the bottom end portions 231 of the rim 230, so that dropping of the anchoring device 200 occurring just before it is pressed against the support surface 300, which is a problem encountered by the above-mentioned prior art, can be prevented.

3) The alarming unit 40 provides functionality for notifying the user that the hot melt adhesive 304 has been heated for a sufficient time period, thereby avoiding overheating of the hot melt adhesive 304.

4) When the user uses this invention to reheat the hot melt adhesive 240 for removing the anchoring device 200, the anchoring device 200 is to be directly pulled and removed by the movable member 31 without the need of any other tool required for the above-mentioned prior art, thereby resulting in convenience during use of this invention.

With this invention thus explained, it is apparent that numerous modifications and variations can be made without departing from the scope and spirit of this invention. It is therefore intended that this invention be limited only as indicated by the appended claims.

I claim:

1. A tool adapted for applying an anchoring device to a support surface, the anchoring device having a forwardly protruding nose for carrying hot melt adhesive, a rear recess, and a rim surrounding the rear recess, said tool comprising:

a housing having an opening;

a heating unit disposed in said housing and having a heating head that extends forwardly out of said housing through said opening and that has a front pressing surface; and a movable unit including a movable member disposed movably on said heating head and extending forwardly out of housing through said opening, and a spring disposed between and abutting against said movable member and an assembly of said housing and said heating head, said movable member having an engagement hole permitting extension of said heating head therethrough, a front annular surface surrounding said engagement hole, a loading portion disposed on said front annular surface, and at least one loading space is defined between said loading portion and said front annular surface, said movable member being movable relative to said heating head between an extended position and a retracted position such that, when said movable member is at said extended position, said front pressing surface of said heating head is spaced apart from the forwardly protruding nose of the anchoring device, and when said movable member is at said retracted position, said front pressing surface is in thermal contact with the forwardly protruding nose, said movable member being biased by said spring toward said extended position.

2. The tool as claimed in claim 1, wherein said loading portion is semi-ring shaped, and has a middle portion connected to said front annular surface, and two hook sections extending respectively and upwardly from two opposite ends of a front portion of said middle portion, said movable member having two said loading spaces, each of said loading spaces being disposed between said front annular surface and a corresponding one of said hook sections.

3. The tool as claimed in claim 2, wherein each of said hook sections has a rear side surface facing toward said front annular surface, said rear side surface having an inclined guiding surface portion at an upper end thereof.

4. The tool as claimed in claim 1, wherein said heating head further has an annular shoulder disposed behind said front pressing surface, said movable member further having a front end wall and a surrounding wall extending rearwardly from a periphery of said front end wall, said engagement hole being formed through said front end wall, said front annular surface being constituted by a front end surface of said front end wall, said spring being configured as a coiled compression spring, abutting against said annular shoulder portion of said heating head and said front end wall, and being disposed in front of said annular shoulder portion and behind said front end wall.

5. The tool as claimed in claim 4, wherein said housing further has a position-limiting shoulder surrounding said opening, said movable member further having at least one position-limiting hook extending rearwardly from said surrounding wall such that, when said movable member is at said extended position, said position-limiting hook of said movable member is in contact with said position-limiting shoulder of said housing, and when said movable member is at said retracted position, said position-limiting hook is spaced apart from said position-limiting shoulder.

6. The tool as claimed in claim 1, wherein said movable member further has a color-variable temperature-sensing layer disposed at said front annular surface and said loading portion.

7. The tool as claimed in claim 1, further comprising an alarming unit disposed in said housing, said alarming unit including an alarm indicator and a start switch connected electrically to said alarm indicator, said movable member further having a push rod extending into said housing such that, when said movable member is at said extended position, said push rod is spaced apart from said start switch, and when said movable member is moved to said retracted position, said push rod comes into contact with and activates said start switch so that, after a predetermined time interval, said alarm indicator is controlled to generate an alarming signal.

8. The tool as claimed in claim 7, wherein said alarm indicator is a buzzer.

* * * * *